US010129635B1

(12) United States Patent
Zhu et al.

(10) Patent No.: US 10,129,635 B1
(45) Date of Patent: Nov. 13, 2018

(54) ANTENNA FOR A WEARABLE AUDIO DEVICE

(71) Applicant: Google Inc., Mountain View, CA (US)

(72) Inventors: Jiang Zhu, Cupertino, CA (US); Chi Kin Benjamin Leung, Sunnyvale, CA (US); Huan Liao, San Jose, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 15/671,783

(22) Filed: Aug. 8, 2017

(51) Int. Cl.
*H04R 1/10* (2006.01)
*H01Q 1/27* (2006.01)
*H01Q 1/48* (2006.01)

(52) U.S. Cl.
CPC ..... *H04R 1/1091* (2013.01); *H01Q 1/273* (2013.01); *H01Q 1/48* (2013.01); *H04R 2420/07* (2013.01)

(58) Field of Classification Search
CPC ..... H04R 25/00; H04R 1/1016; H04R 5/033; H04R 2420/07; H04R 2499/11
USPC ..... 381/74, 380; 181/129, 130, 137
See application file for complete search history.

(56) References Cited

U.S. PATENT DOCUMENTS 6,671,494 B1 * 12/2003 James ..... H04B 1/385 381/15
2007/0080891 A1 * 4/2007 De Lustrac ..... H01Q 3/446 343/909
2008/0056526 A1 * 3/2008 Dunn ..... H04R 1/1016 381/380
2009/0231211 A1 9/2009 Zweers
2017/0170799 A1 6/2017 Kong et al.
2017/0195466 A1 * 7/2017 Chen ..... H04M 1/026
2017/0220137 A1 * 8/2017 Han ..... G06F 3/0362

FOREIGN PATENT DOCUMENTS

| | | |
|---|---|---|
| CN | 106060698 | 10/2016 |
| EP | 1403964 | 3/2004 |
| EP | 1906487 | 4/2008 |
| EP | 3110174 | 12/2016 |
| JP | 2007235608 | 9/2007 |

OTHER PUBLICATIONS

International Search Report and Written Opinion for PCT/US2018/038554 dated Sep. 13, 2018, 16 pages.

* cited by examiner

*Primary Examiner* — Melur Ramakrishnaiah
(74) *Attorney, Agent, or Firm* — Dority & Manning, P.A.

(57) ABSTRACT

Example wearable audio devices are disclosed. In one example implementation, a wearable audio device includes a housing defining an interior and an exterior. The exterior can have an ear engaging surface. The wearable audio device can include an audio source located within the interior of the housing. The wearable audio device can include an antenna located within the interior. The antenna can have an arc-shaped conductor with a first end and a second end defining an opening. The antenna can be positioned within the housing of the wearable audio device such that the opening of the antenna is positioned further from an ear relative to a middle portion of the arc-shaped conductor when the wearable audio device is worn in the ear.

20 Claims, 15 Drawing Sheets

ANTENNA FOR A WEARABLE AUDIO DEVICE

FIELD

The present disclosure relates generally to wearable audio devices.

BACKGROUND

Antennas can be used in conjunction with wearable devices to communicate signals wirelessly to the wearable device. Implementing antennas for small wearable devices, such as earbuds, can be challenging for a number of reasons. For example, the volume available for the antenna can be small due to a constraint of a small form factor of a device. However, performance of the antenna can be highly dependent on the size of the antenna. As another example, the space available for a ground plane for an antenna can be small. A reduction of a size of the ground plane can lead to degradation of an antenna radiation performance.

As a further example, a physical clearance between an antenna and other components, such as a touch panel, a microphone, a printed circuit board, etc., in the wearable device can be small. A small clearance can cause high radio frequency coupling between the antenna and the other components, which can lead to antenna performance degradation and large variations in a performance of the antenna due to a large tolerance of the other components in an assembly. As a further example, several body effects can degrade a performance of an antenna. The effects can include attenuation, detuning, and shadowing, due to body parts, such as skin, being a highly lossy medium with high permittivity at high frequencies.

SUMMARY

Aspects and advantages of embodiments of the present disclosure will be set forth in part in the following description, or may be learned from the description, or may be learned through practice of the embodiments.

One example aspect of the present disclosure is directed to a wearable audio device. The wearable audio device can include a housing defining an interior and an exterior. The exterior can have an ear engaging surface. The wearable audio device can include an audio source located within the interior of the housing. The wearable audio device can include an antenna located within the interior. The antenna can have an arc-shaped conductor with a first end and a second end defining an opening. The antenna can be positioned within the housing of the wearable audio device such that the opening of the antenna is positioned further from an ear relative to a middle portion of the arc-shaped conductor when the wearable audio device is worn in the ear.

Other example aspects of the present disclosure are directed to systems, apparatus, tangible, non-transitory computer-readable media, and devices associated with a wearable audio device.

These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

Detailed discussion of embodiments directed to one of ordinary skill in the art are set forth in the specification, which makes reference to the appended figures, in which.

DETAILED DESCRIPTION

Figure 1:
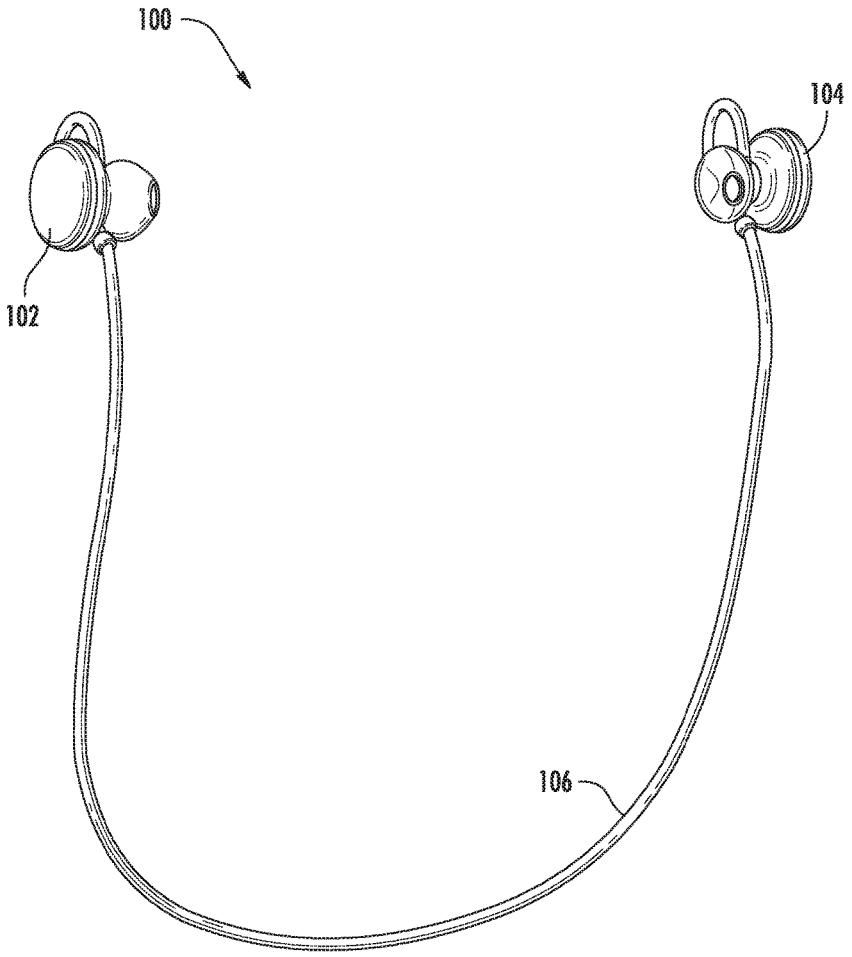
FIG. 1 depicts a wearable audio device system according to example embodiments of the present disclosure.

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

Example aspects of the present disclosure are directed to an antenna for use with a wearable audio device, such as an earbud for providing audio to a user. According to example embodiments of the present disclosure, the antenna can be designed and integrated into the wearable audio device to improve antenna performance. For instance, the antenna can be integrated into the wearable audio device such that a portion of the antenna associated with a maximum electric field and/or a minimum current can be located furthest from tissue when the wearable audio device is worn by a user (e.g., when in the user's ear).

In some embodiments, a wearable audio device can include a housing with a top cover. The antenna can be an arc-shaped or curved conductor having a first end and a second end defining an opening. The antenna can be located in the top cover of the wearable audio device. For instance, in some embodiments, the antenna can be printed on an inner surface of the top cover using a laser direct structuring process. The antenna can be configured to operate at varying frequencies, such as about 2.4 GHz. In some embodiments, the antenna can have length that is a half-wavelength long. This can increase the antenna area and the radiation efficiency.

A feed element can be coupled to antenna at a location proximate to the first end or the second end. The feed element can be coupled to the antenna at a location where the impedance is about 50 Ohms. The feed element can be used to excite the antenna. When excited, the antenna can have a maximum electric field at a portion of the antenna proximate the opening defined by the first end and the second end. The antenna can be positioned within the top cover of the wearable audio device such that the opening is located further from the ear relative to other portions of the antenna (e.g., portions associated with a maximum current) when the wearable audio device is worn by a user. In this way, the antenna can be positioned within the wearable audio device such that the maximum electric field for the antenna is as far away from an ear as the form factor of the wearable audio device allows. Positioning the antenna in this manner can have the technical advantage of reducing performance loss the antenna experiences by being in close proximity with skin, such as detuning, attenuation, and shadowing effect.

In some embodiments, the wearable audio device can include one or more component(s) located proximate the antenna in the housing, such as touch panel used to control the wearable audio device. For instance, a touch panel can be located with an area defined by the arc-shaped conductor. The touch panel, in some embodiments, can include closely spaced planar metal sheets co-located with the antenna in the top cover. To reduce interference caused by the touch panel with the antenna, a ground plane can be implemented proximate to the touch panel. For instance, a ground plane can be disposed in spaced parallel relationship with the touch panel. The ground plane can reduce metal loss from the touch panel or other circuit components in the wearable audio device.

In some embodiments, the ground plane can be a meshed (e.g., slotted ground plane). Use of a meshed ground plane can reduce capacitance between the touch panel and the ground plane. This can have a technical effect of improving touch sensing sensitivity of the touch panel.

In some embodiments, the ground plane can include an extension that follows a path associated with conductors in communication with the touch panel (e.g., used to communicate signals to a printed circuit board in the wearable audio device). The extension can be a solid portion of the ground plane.

In some embodiments, conductor(s) used to carry power and/or audio signals in the wearable audio device can include RF chokes at a location where the conductor(s) are connected to a printed circuit board in the wearable audio device. The RF chokes can be used to isolate the conductors from the antenna and reduce antenna performance variations resulting from the conductors.

As used herein, the term "arc-shaped" refers to any shape that forms an arc, bow, or arcuate shape. An arc-shaped antenna can be composed of one or more curved segments, a plurality of straight segments arranged to form an arc, or combination of curved, straight, and other segments. The use of the term "about" in conjunction with a numerical value refers to within 20% of the stated numerical value.

With reference now to the FIGS., example embodiments of the present disclosure will now be set forth. Aspects of the present disclosure will be discussed with reference to a wearable audio device such an earbud for providing audio to a user. FIG. 1 depicts a wearable audio device system 100 according to example embodiments of the present disclosure. The wearable audio device system 100 can include a first wearable audio device 102, a second wearable audio device 104, and a connector (e.g., cable, cord, etc.) 106 to connect the first wearable audio device 102 and the second wearable audio device 104. At least one of the first wearable audio device 102 and the second wearable audio device 104 can include an antenna for communicating wireless signals. The antenna can be configured in accordance with example embodiments of the present disclosure.

Figure 2:
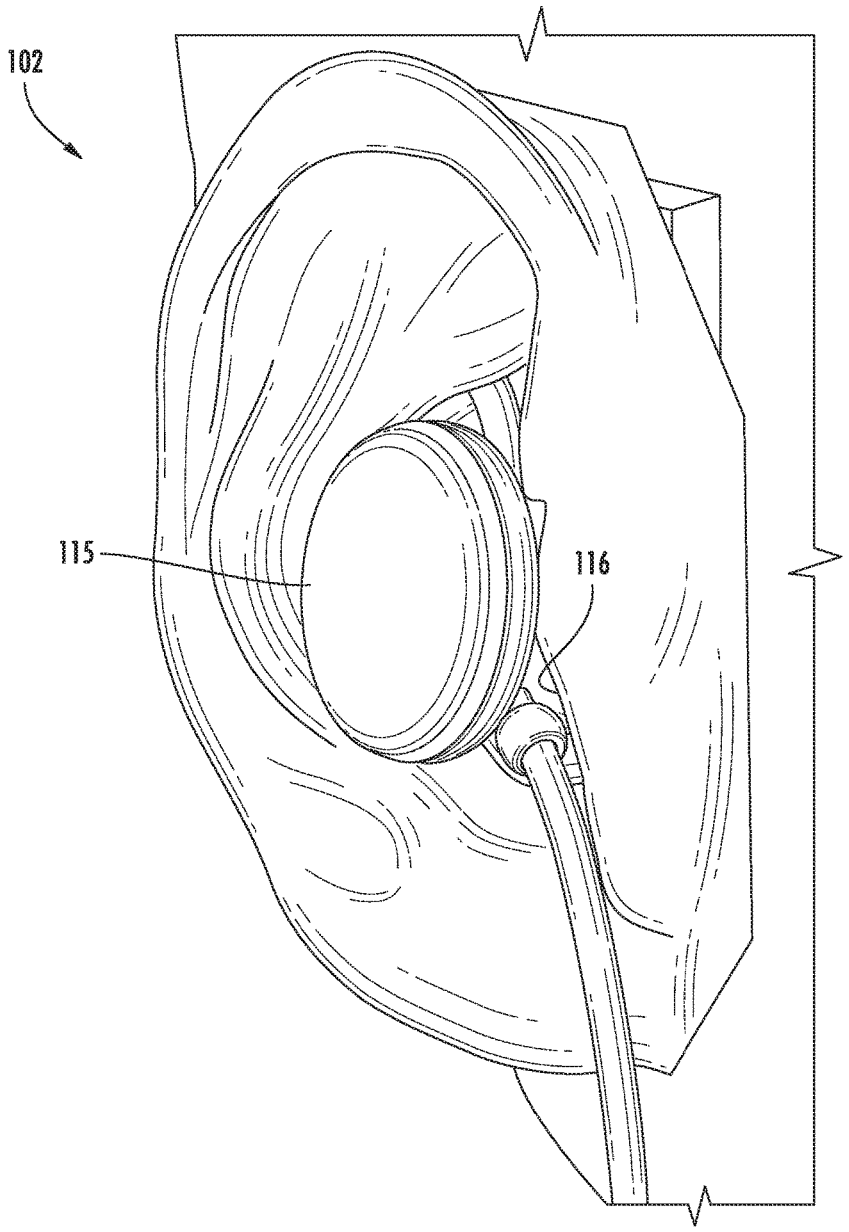
FIG. 2 depicts a wearable audio device in ear according to example embodiments of the present disclosure.

As shown in FIG. 2, the wearable audio device 102 can be worn in a user's ear. The wearable audio device 102 can provide audio to a user to allow the user to, for instance, listen to music, listen to a person speaking by telephone or video call, listen to audio playback, or listen to other audio output from a user device, such as a smartphone, laptop, tablet, desktop, display with one or more processors, wearable device, or other user device.

Figure 3:
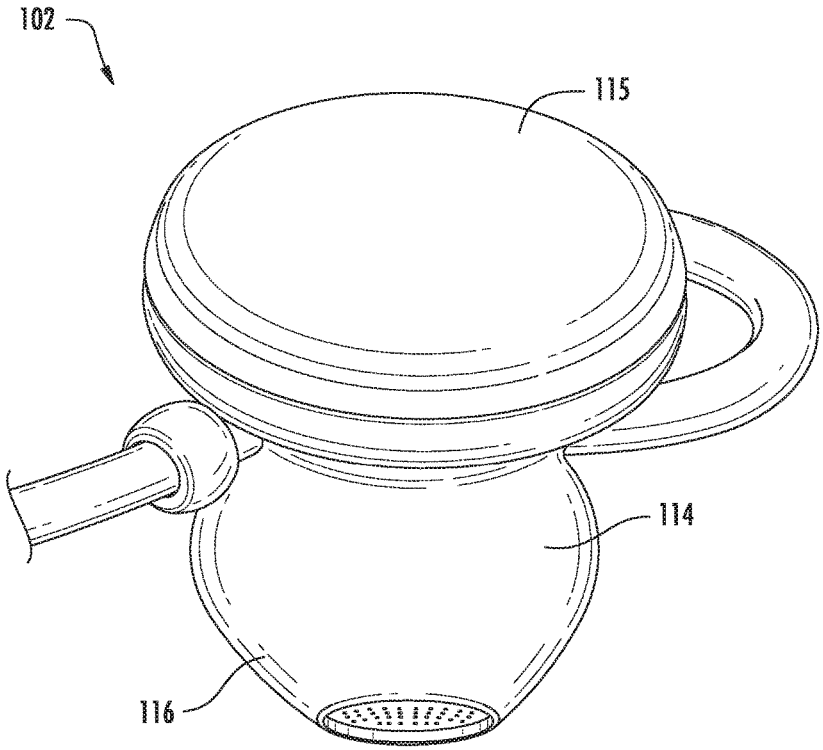
FIG. 3 depicts a wearable audio device according to example embodiments of the present disclosure.

Referring to FIG. 3, the wearable audio device 102 can include a housing 114. The housing 114 can house various interior components of the wearable audio device, such as an antenna, touch panel, audio source, printed circuit board, conductors used to communicate audio signals, an audio source, etc.

The housing 114 include an ear engaging surface 116 that shaped and sized to fit within a user's ear. The ear engaging surface 116 can include, at least in part, a polyamide material. The housing 114 can include a top cover 115. The top cover 115 can house, for instance, an antenna for the wearable audio device. In some embodiments, the top cover 115 can be removable from the housing 114. The top cover 115 can be made using, for instance, a laser direct structuring process. As shown in FIG. 2, when the wearable audio device 102 is worn in a user's ear, the ear engaging surface 116 is engaged with the ear. The top cover 115 can extend away from the ear and be exposed when the wearable audio device 102 is worn in the ear.

Figure 4:
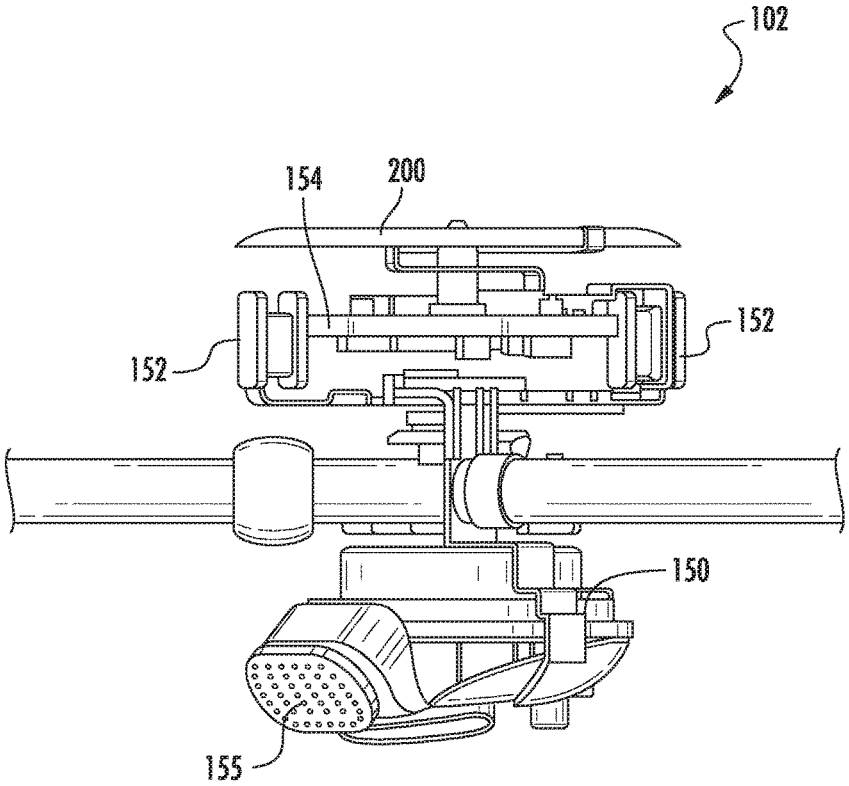
FIG. 4 depicts interior components of a wearable audio device according to example embodiments of the present disclosure.
Figure 5:
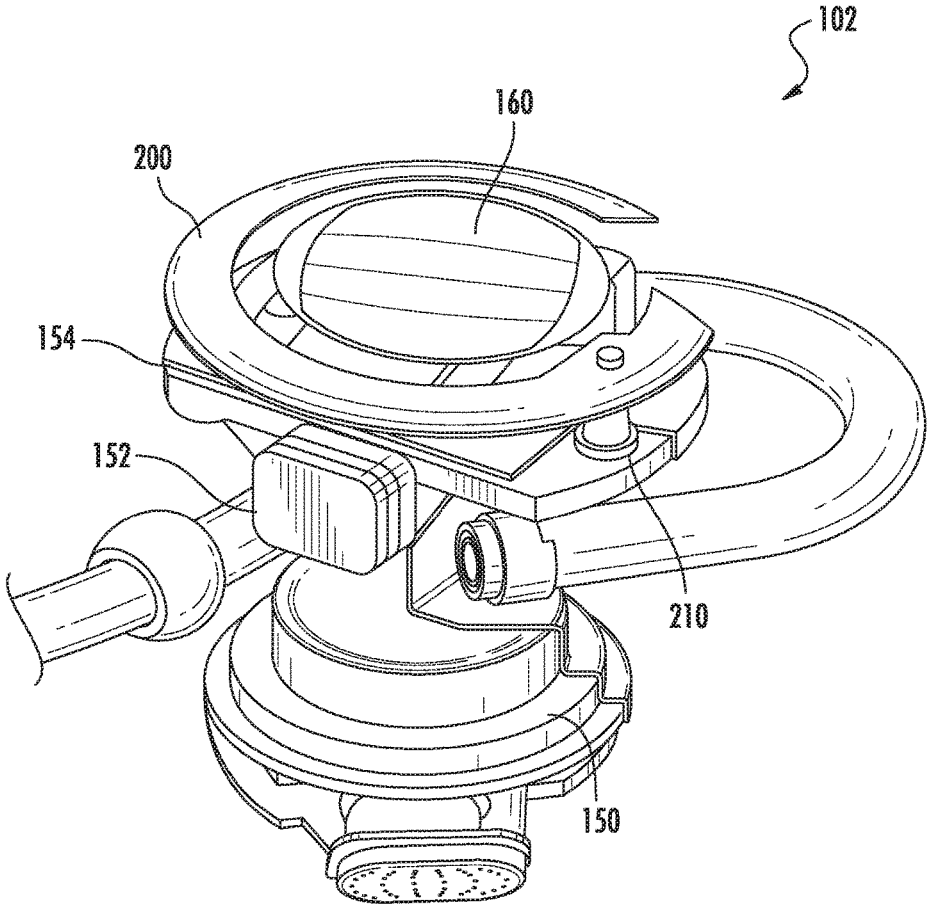
FIG. 5 depicts interior components of a wearable audio device according to example embodiments of the present disclosure.

FIGS. 4 and 5 depict interior components of a wearable audio device according to example embodiments of the present disclosure. Example components can include an audio source 150. The audio source 150 can be, for instance, a speaker drive. The speaker drive can convert electrical signals communicated via one or more conductors to the speaker drive to audio for output via speaker 155.

The wearable audio device 102 can include one or more microphones 152. The microphone(s) 152 can be configured to record ambient noise observable near the wearable audio device. The ambient noise can be used, for instance, to provide noise cancelling capabilities for the wearable audio device 102.

The wearable audio device 102 can include a printed circuit board 154 (e.g., a flexible printed circuit board). The printed circuit board 154 can include various circuit components (e.g., processors, memory, signal processing circuits, application specific integrated circuits, etc.) used to provide audio output from a source to a user.

The wearable audio device 102 can include a touch panel 160. The touch panel 160 can be used to detect touch inputs from a user (e.g., the user touching the top cover 115 of the housing 114). Signals associated with the touch inputs can be communicated to the printed circuit board 154 to control various operating characteristics of the wearable audio device (e.g., volume, mute, channel, etc.).

The wearable audio device 102 can include an antenna 200. The antenna 200 can be used to communicate wireless signals (e.g., RF signals) to and/or from the wearable audio device 102. A feed element 210 can communicate signals from the antenna 200 to and/or from the printed circuit board 154.

Figure 6:
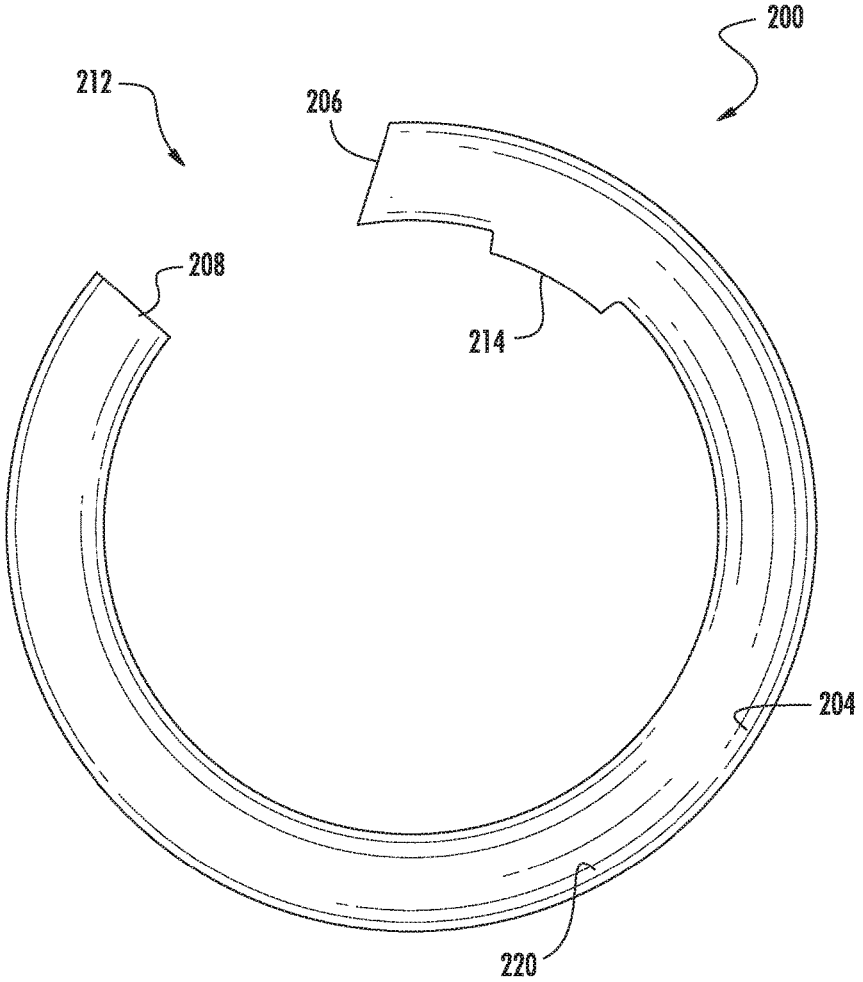
FIG. 6 depicts a plan view of an antenna according to example embodiments of the present disclosure.

FIG. 6 depicts a plan view of an example antenna 200 according to example embodiments of the present disclosure. As shown, the antenna 200 includes an arc-shaped conductor 204 (e.g., a trace). The arc-shaped conductor 204 includes a first end 206 and a second end 208 defining an opening 212. The arc-shaped conductor 204 can include a middle portion 220 between the first end 206 and the second end 208 (e.g., half way between the first end 206 and the second end 208). A connecting portion 214 of the arc-shaped conductor 204 is located proximate the first end 206. The connecting portion 214 has a width that is greater than width associated with the remainder of the arc-shaped conductor 204. The connecting portion 214 can be configured to receive the feed element 210.

In some embodiments, the arc-shaped conductor 204 can have a length configured to accommodate communicating RF signals at a particular frequency. For instance, the arc-shaped conductor 204 can have a length equal to about a $\lambda/2$ for a particular operating frequency where $\lambda$ is the wavelength associated with the particular frequency. In one example embodiments, the arc-shaped conductor 204 has a length configured to communicate signals at about 2.4 GHz.

Figure 7:
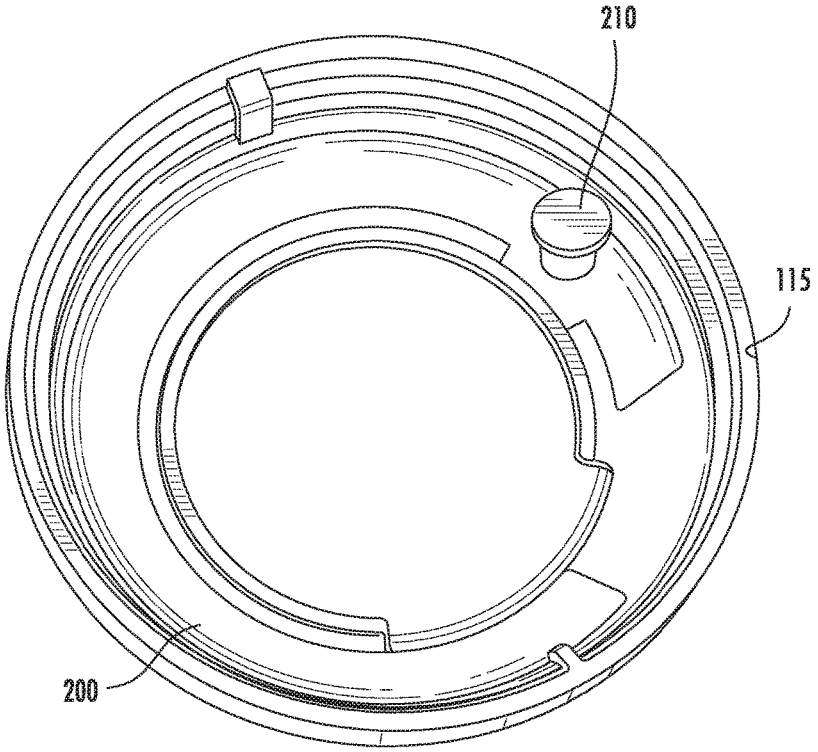
FIG. 7 depicts an antenna located in the interior of a top cover for a wearable audio device housing according to example embodiments of the present disclosure.

According to example embodiments of the present disclosure, the antenna 200 can be located within the top cover 115 of the wearable audio device 102. For instance, as shown in FIG. 7, the antenna 200 can extend around a peripheral portion of the circular top cover 115. In some embodiments, the antenna 200 can be printed onto the circular top cover 115 (e.g., using a laser direct structuring process). The feed element 210 extends from the connecting portion 214 of the antenna 200.

Figure 8:
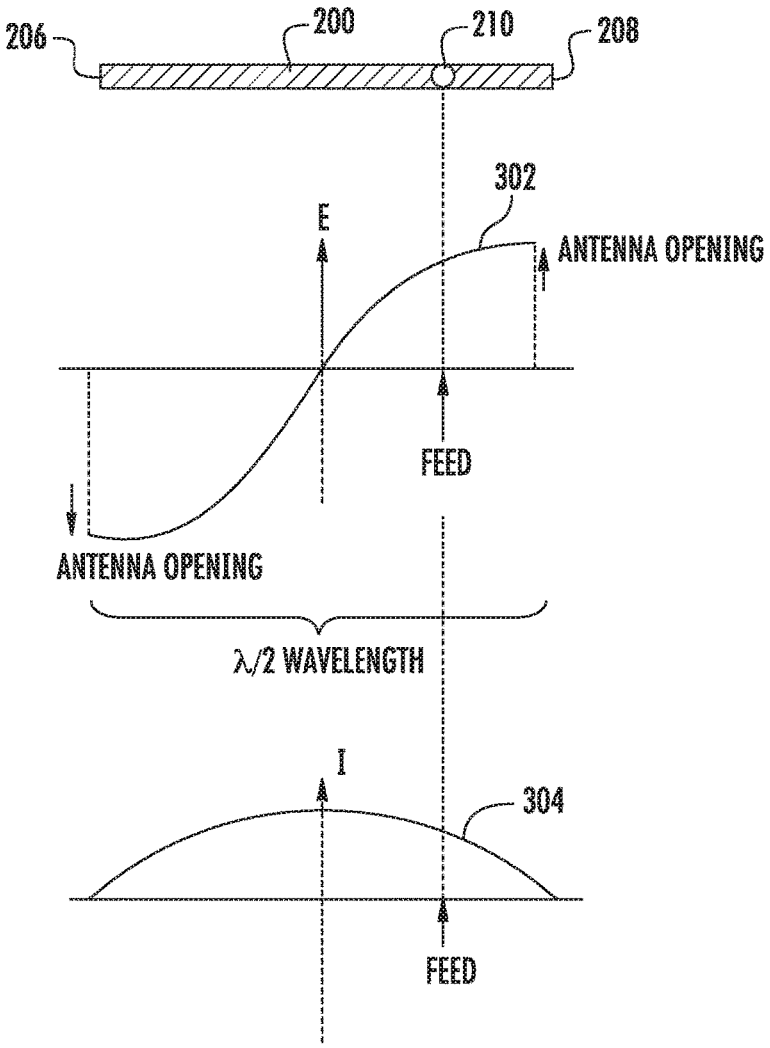
FIG. 8 depicts electrical field and current distribution for an antenna implemented in a wearable audio device according to example embodiments of the present disclosure.

FIG. 8 depicts plots of electric field and current about the azimuth of the antenna 200. More particularly, curve 302 plots electric field as a function of azimuth about the antenna 200. As shown, the electric field is at a maximum at a location proximate first end 206 and second end 208 (e.g., proximate the opening 212) of the antenna 200. The electric field is at a minimum at or near the middle portion 220 of the antenna 200.

Curve 304 plots current as a function of azimuth about the antenna 200. As shown, the current is at a maximum at a location proximate middle portion 220 of the antenna 200. The current is at a minimum at a location proximate the first end 206 and the second end 208 (e.g., proximate the opening 212) of the antenna 200.

According to example aspects of the present disclosure, the antenna 200 is positioned and/or oriented within the wearable audio device 102 (e.g., within the top cover 115) such that when the wearable audio device 102 is worn in a user's ear, the portion of the antenna 200 associated with a maximum electric field is located further away from a user's ear relative to the portion of the antenna 200 associated with a minimum electric field. For instance, the portion of the antenna associated with a minimum current is located further away from a user's ear relative to the portion of the antenna 200 associated with a maximum current.

Figure 9:
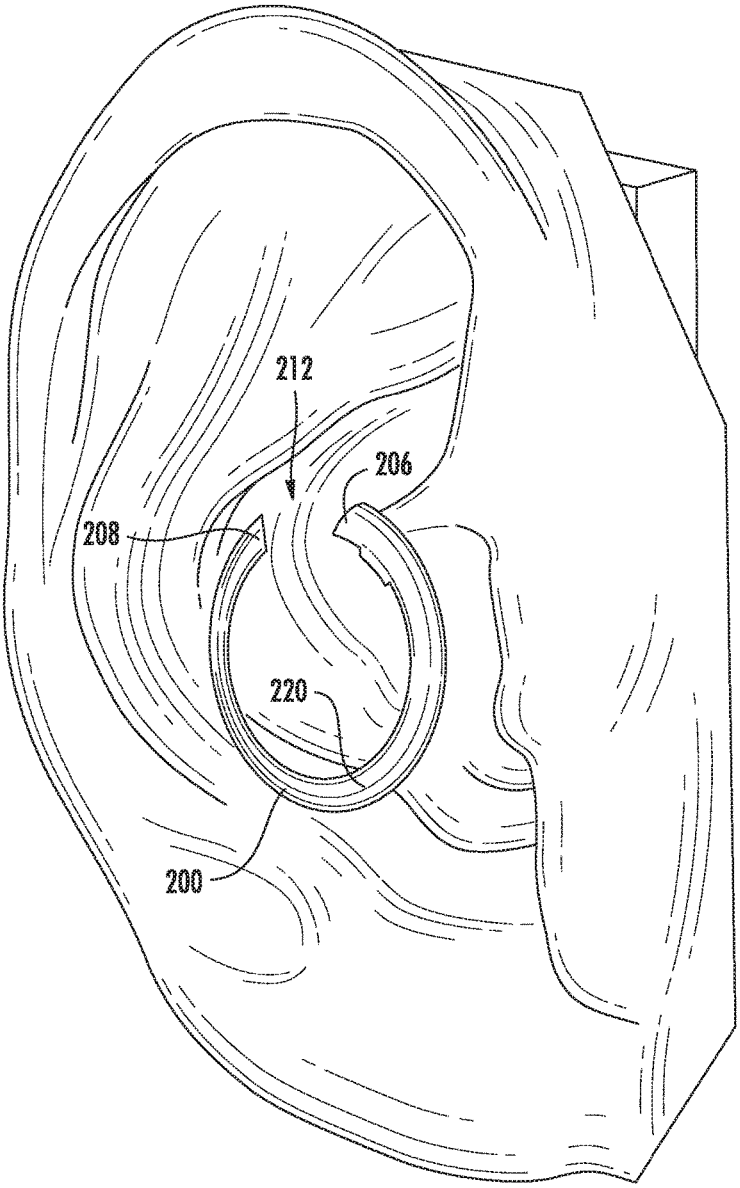
FIG. 9 depicts an antenna situated relative to a human ear according to example embodiments of the present disclosure.

FIG. 9 depicts one example positioning of an antenna relative to a user's ear according to example embodiments of the present disclosure. As shown in FIG. 9, the antenna 200 can be positioned and/or oriented such that opening 212 defined by the first end 206 and the second end 208 is located further from the ear relative to middle portion 220 of the antenna 200. In this way, performance degradation of the antenna 200 resulting from the ear can be reduced.

Figure 10:
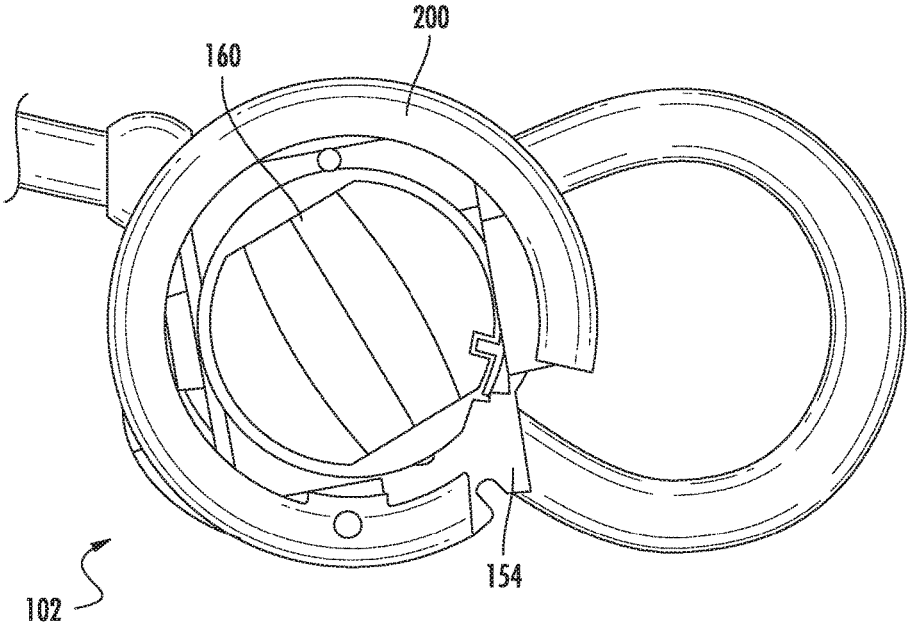
FIG. 10 depicts an antenna situated proximate a touch panel for a wearable audio device according to example embodiments of the present disclosure.
Figure 11:
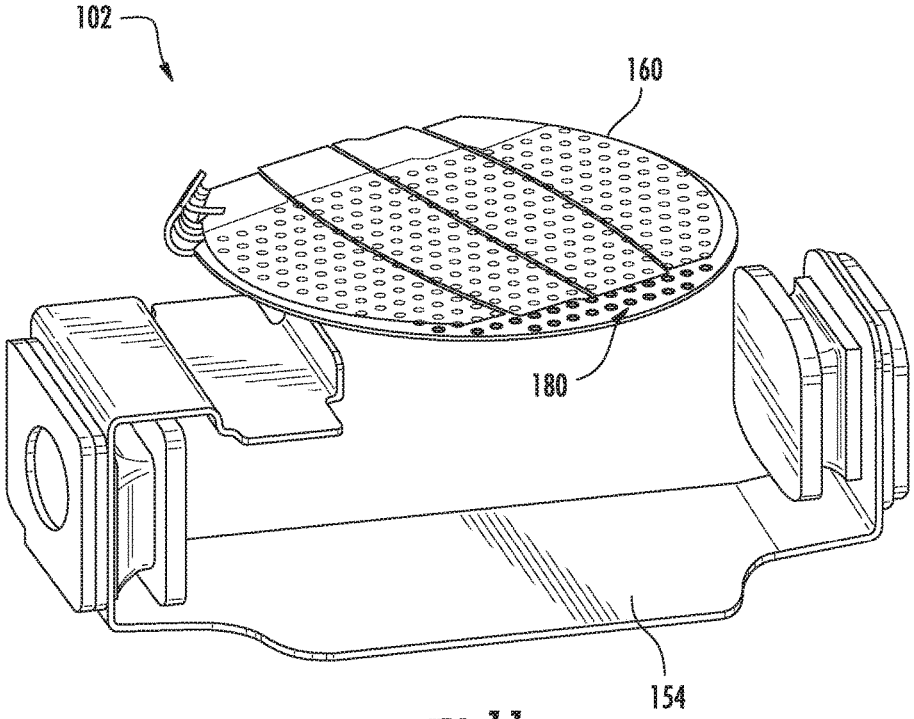
FIG. 11 depicts a ground plane and touch panel for a wearable audio device according to example embodiments of the present disclosure.
Figure 12:
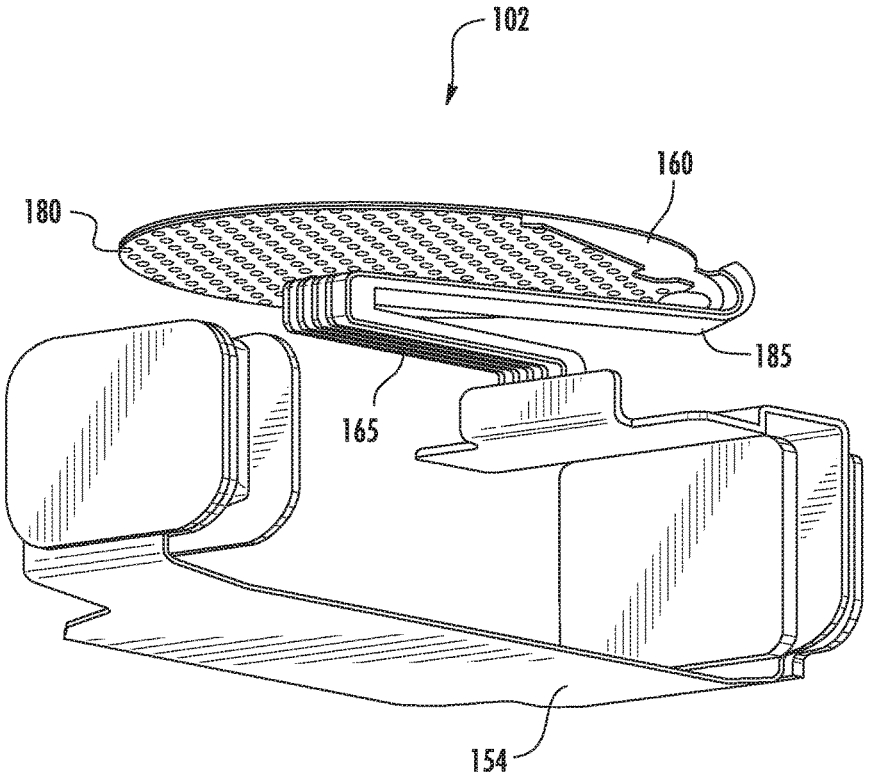
FIG. 12 depicts a ground plane and touch panel for a wearable audio device according to example embodiments of the present disclosure.

FIGS. 10, 11 and 12 depict the example implementation of a ground plane in a wearable audio device 102 according to example embodiments of the present disclosure. The wearable audio device 102 can include a touch panel 160 or a sensor. The touch panel 160 can include closely spaced planar metal sheets. The touch panel 160 can be arranged within an area A defined by an arc-shaped antenna. For instance, the touch panel 160 can be arranged within a top cover 115 with the antenna 200.

The touch panel can be used to detect touch inputs from a user (e.g., the user touching the top cover 115 of the housing 114). Signals associated with the touch inputs can be communicated to the printed circuit board 154 to control various operating characteristics of the wearable audio device (e.g., volume, mute, channel, etc.). The touch panel 160 can be arranged over a printed circuit board 154 for the wearable audio device 102. The touch panel 160 can provide signals to the printed circuit board 154 via one or more conductors 165.

Because of the close proximity of the touch panel 160 to the antenna 200, the touch panel 160 can affect operating performance of the antenna 200. To reduce variations in operating performance of the antenna 200 resulting from the touch panel 160, a ground plane 180 can be disposed in spaced parallel relation with the touch panel 160. The ground plane 180 can be a conductive plane. In some embodiments, the ground plane 180 can be meshed (e.g., slotted) to reduce capacitance between the touch panel 160 and the ground plane 180.

As shown in FIG. 12, the ground plane 180 can include an extension 185 that follows a path taken by conductor(s) 165 used to connect the touch sensor 160 to the printed circuit board 154. The extension 185 can be a solid conductive material. The extension 185 can connect the ground plane 180 to the printed circuit board 154.

Figure 13:
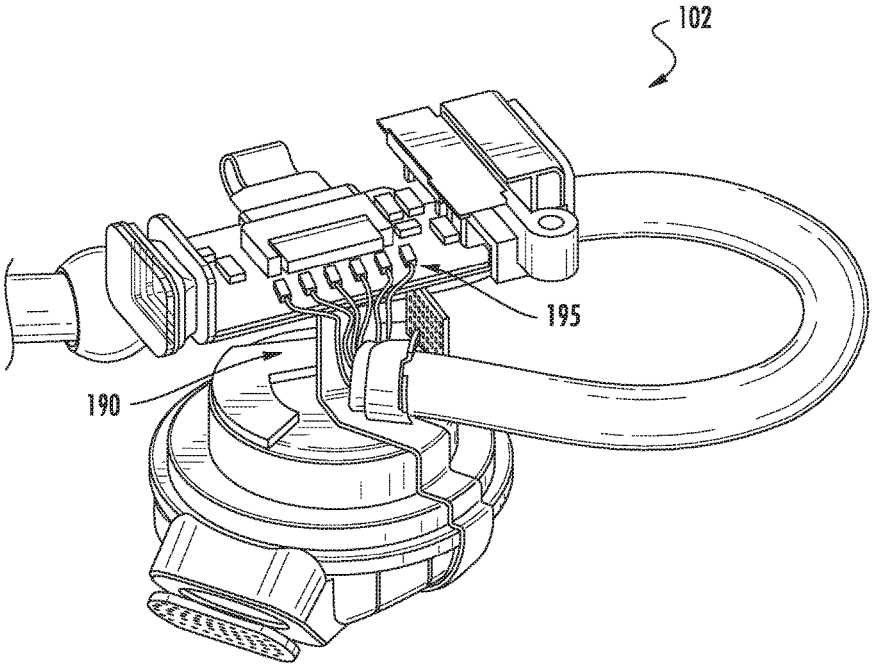
FIG. 13 depicts radio frequency chokes implemented as part of a wearable audio device according to example embodiments of the present disclosure.

FIG. 13 depicts a wearable audio device 102 that includes RF chokes according to example embodiments of the present disclosure. More particularly, each conductor(s) 190 used to communicate power and/or signals to the wearable audio device 102 can include an RF choke 195. In some embodiments, the conductor(s) 190 can include the RF choke 195 at a location where the conductor is connected to the printed circuit board 154. The RF choke 195 can eliminate or reduce RF noise from a signal received and/or created by an antenna.

Figure 14:
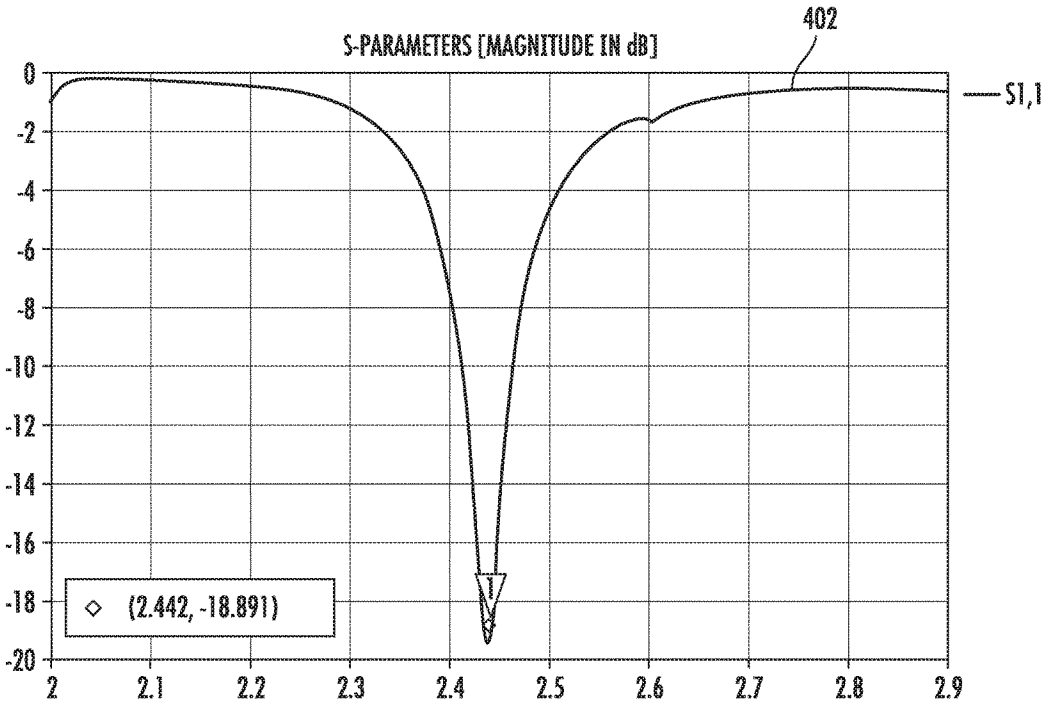
FIG. 14 depicts antenna return loss of an example antenna according to example embodiments of the present disclosure.

FIG. 14 depicts example performance characteristics of an antenna for a wearable audio device according to example embodiments of the present disclosure. FIG. 14 plots S11 parameters (e.g. reflection coefficients) (in dB) along the vertical axis and frequency along the horizontal axis. As shown by curve 402, the antenna exhibits good performance characteristics at its intended operating frequency (e.g., about 2.4 GHz).

Figure 15:
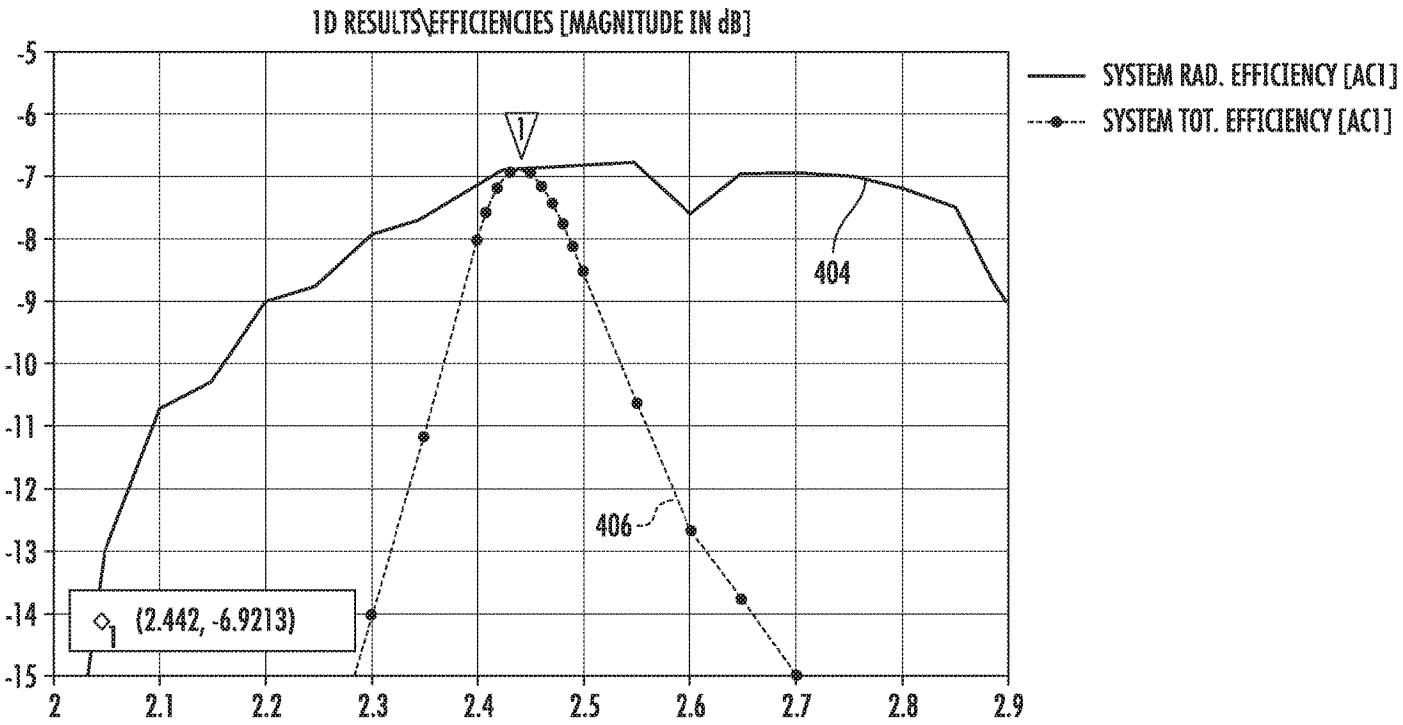
FIG. 15 depicts antenna radiation and total efficiency of an according to example embodiments of the present disclosure.

FIG. 15 depicts example performance characteristics of an antenna for a wearable audio device according to example embodiments of the present disclosure. FIG. 15 plots antenna efficiency (in dB) along the vertical axis and frequency along the horizontal axis. Curve 404 represents radiation efficiency for the antenna. Curve 406 represents total efficiency for the antenna. As demonstrated, the antenna demonstrates good efficiencies at its intended operating frequency (e.g., about 2.4 GHz).

While the present subject matter has been described in detail with respect to specific example embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A wearable audio device comprising:

a housing defining an interior and an exterior, the exterior having an ear engaging surface;

an audio source being contained within the interior of the housing;

an antenna located within the interior, the antenna comprising an arc-shaped conductor with a first end and a second end defining an opening; and wherein the antenna is positioned within the housing such that the opening of the antenna is positioned further from an ear relative to a middle portion halfway between the first end and the second end of the arc-shaped conductor when the wearable audio device is worn in the ear.

2. The wearable audio device of claim 1, wherein the first end and the second end are associated with a maximum electric field for the antenna.

3. The wearable audio device of claim 1, wherein the middle portion is associated with a maximum current for the antenna.

4. The wearable audio device of claim 1, wherein the housing comprises a top cover, wherein the antenna is arranged within the top cover.

5. The wearable audio device of claim 1, wherein the wearable audio device comprises:

a touch panel located within an area defined by the arc-shaped conductor; and a ground plane located in spaced parallel relationship with the touch panel.

6. The wearable audio device of claim 5, wherein at least a portion of the ground plane is meshed.

7. The wearable audio device of claim 1, wherein the wearable audio device comprises a feed element coupled to a connecting portion proximate the first end of the antenna.

8. The wearable audio device of claim 1, wherein the wearable audio device comprises one or more conductors for communicating signals associated with the wearable audio device.

9. The wearable audio device of claim 8, wherein each of the one or more conductors is coupled to a radio frequency (RF) choke at a location where the conductor connected to a printed circuit board located within this housing.

10. A wearable audio device comprising:

a housing defining an interior and an exterior, the exterior having an ear engaging surface, the housing including a top cover that extends away from an ear when the wearable audio device is worn in the ear;

an audio source being contained within the interior of the housing; and an antenna located within the top cover, the antenna comprising an arc-shaped conductor with a first end and a second end with an opening defined between the first end and the second end, the opening of the antenna positioned further from an ear relative to a middle portion halfway between the first end and the second end of the arc-shaped conductor.

11. The wearable audio device of claim 10, wherein the antenna is printed onto the top cover.

12. The wearable audio device of claim 11, wherein the antenna is positioned within the top cover such that the opening of the antenna is positioned further from an ear relative to a middle portion of the arc-shaped conductor when the wearable audio device is worn in the ear.

13. The wearable audio device of claim 12, wherein the first end and the second end are associated with a maximum electrical field for the antenna.

14. The wearable audio device of claim 11, wherein the wearable audio device comprises:

a touch panel located within an area defined by the arc-shaped conductor; and a ground plane located proximate to the touch panel.

15. The wearable audio device of claim 14, wherein at least a portion of the ground plane is meshed.

16. A wearable audio device comprising:

a housing defining an interior and an exterior, the exterior having an ear engaging surface;

an audio source being contained within the interior of the housing;

an antenna located within the interior of the housing, the antenna comprising an arc-shaped conductor with a first end and a second end with an opening defined between the first end and the second end, the opening of the antenna positioned further from an ear relative to a middle portion halfway between the first end and the second end of the arc-shaped conductor;

a metal component located within an area defined by the arc-shaped conductor; and a ground plane located in spaced parallel relationship with the metal component.

17. The wearable audio device of claim 16, wherein the housing comprises a top cover, the antenna and the metal component being located within the top cover.

18. The wearable audio device of claim 16, wherein the ground plane comprises an extension that follows a path associated with a conductor coupling the metal component to a printed circuit board located within the interior of the housing.

19. The wearable audio device of claim 16, wherein the ground plane is meshed.

20. The wearable audio device of claim 16, wherein the metal component comprises a touch panel.

* * * * *